United States Patent [19]

Kaiser

[11] Patent Number: 4,710,224

[45] Date of Patent: Dec. 1, 1987

[54] PROCESS FOR INTRODUCING BATH COMPONENTS INTO ELECTROLYTIC AND CURRENTLESS BATHS

[75] Inventor: Hasso Kaiser, Schwabische Gmund, Fed. Rep. of Germany

[73] Assignee: DEGUSSA Aktiengesellschaft, Frankfurt am Main, Fed. Rep. of Germany

[21] Appl. No.: 47,495

[22] Filed: May 6, 1987

Related U.S. Application Data

[63] Continuation of Ser. No. 586,264, Mar. 5, 1984, abandoned.

[30] Foreign Application Priority Data

Mar. 5, 1983 [DE] Fed. Rep. of Germany ..... 3307901

[51] Int. Cl.[4] ..... C23C 18/40

[52] U.S. Cl. ..... 106/1.23; 427/345; 427/443.1

[58] Field of Search ..... 106/1.23; 427/345, 443.1

[56] References Cited

U.S. PATENT DOCUMENTS

| | | | |
|---|---|---|---|
| 2,819,188 | 1/1958 | Metheny | 427/438 |
| 3,033,703 | 5/1962 | Schneble | 427/305 |
| 3,338,740 | 8/1967 | Katz | 427/438 |
| 3,876,434 | 4/1975 | Dutkewych | 427/345 |
| 4,152,467 | 5/1979 | Alpaugh | 427/345 |

FOREIGN PATENT DOCUMENTS

| | | | |
|---|---|---|---|
| 715944 | 8/1965 | Canada | 427/305 |
| 57-152457 | 9/1982 | Japan | 427/305 |

*Primary Examiner*—John D. Smith

*Attorney, Agent, or Firm*—Cushman, Darby & Cushman

[57] ABSTRACT

Process for introducing bath components into electrolytic and currentless (electroless) baths for the deposition of metal for deposition of metal layers, especially for introducing reducing agents in currentless baths, characterized by the bath components being introduced are admixed by an inert gas flowing through the bath.

1 Claim, No Drawings

PROCESS FOR INTRODUCING BATH COMPONENTS INTO ELECTROLYTIC AND CURRENTLESS BATHS

This is a continuation of application Ser. No. 586,264, filed Mar. 5, 1984, which was abandoned upon the filing hereof.

The invention is directed to a process for introducing bath components into electrolytic and currentless baths to deposit metal layers, especially for introducing reducing agent into currentless baths.

Electrolytic and currentless baths for depositing metal layers in the source of the chemical process arts can be understood as batch reactors whose material balance apart from a very few exception does not go to zero. This means that during the operation of the baths chemical materials are consumed which are not automatically replenished through the transfer process during the electrolysis by dissolving the anode so that in the course of time there arises a deficiency of these materials necessary for the deposition of metal. Such materials can be, for example, brighteners, grain refiners, leveling agents, wetting agents, or reducing agents.

These materials are regenerated in the bath after a period of time established by analysis, by replenishing the bath by again adding them.

However, this process has the disadvantage that the operation of the bath thereby generally must be interrupted and decreasing concentrations of these materials between addition to the bath and renewed regeneration influence the properties of the metal layers being deposited.

Especially the operation of automatically operating reducing baths assumes that besdes soluble metal salts there are also added to the electrolytes strong reducing agents. These reducing agents are water soluble and, as in the case of hydrazine or the boranes very reactive. In order to have a regulated deposition it is necessary to have a uniform distribution of these reducing agents in the metal salt solution. Furthermore, in working with the baths, the reducing agent is permanently consumed. In order to avoid undesired reactions, it is necessary to admix these materials with the electrolytes in correspondingly great dilution. This leads to a permanent increase of the volume of the bath since the solvent is not consumed in the reducing reaction. Normally, the excess solvent must be distilled off at elevated temperature which leads to a corresponding consumption of energy.

Therefore, it was the problem of the present invention to find a process for introducing bath components into electrolytic and currentless baths for the deposition of metal layers, especially for introducing reducing agents into currentless baths in which it is not necessary to interrupt the operation of the bath. There is always maintained an approximately constant concentration of the corresponding components of the bath and no dilution of the electrolytes occurs.

This problem is solved according to the invention by admixing the components being brought into the bath by an inert gas flowing through the bath. Argon and nitrogen have proven good as inert gases.

The process of the invention can be carried out especially simply with materials that are liquid or volatile and form a gaseous mixture with the inert gas at normal temperature. Other materials must optionally be converted into a volatile, liquid, or gaseous form.

The following examples explain the process of the invention more specifically.

1. A current of nitrogen is led through hydrazine and the thus formed nitrogen hydrazine vapor mixture through a glass frit led in the form of fine gas bubbles through a working electrolyte for the deposition of copper layers. The electrolyte dissolves the hydrazine uniformly from the rising vapor bubble stream. Any none dissolved hydrazine is eliminated through suction on the bath surface, in order to avoid thereby irritations in the operations with the electrolytes. Through this there can always be produced a uniform hydrazine concentration in the bath.

2. In practice, in the electroplating art there are introduced to the reductively operating baths strongly reducing polyborines in the form of derivatives such as sodium borohydride or dimethylaminoborane. For this purpose, a stream of argon is led through liquid pentaborohydrin. Consequently, the highly active material without ballast matterial is introduced into the electrolytes where it can be effective immediately.

A further advantage of the process of the invention is shown in that after the shutting off of the supply of gas the reduction in the electrolytes immediately subsides since the life of this strong reducing agent is only very short. Undesired reactions during pauses in operation accordingly are avoided.

I claim:

1. A process for introducing bath components into a currentless bath for the deposition of copper or deposition of copper layers, comprising introducing a water soluble reducing agent which is hydrazine and together with an inert gas into the bath and admixing the bath components by flowing said gas.

* * * * *